US005713816A

United States Patent [19]

Glover

[11] Patent Number: 5,713,816

[45] Date of Patent: Feb. 3, 1998

[54] ISOMETRIC NECK EXERCISER AND METHOD

[76] Inventor: James T. Glover, 4577 Saville Ct., Independence, Mo. 64055

[21] Appl. No.: 753,981

[22] Filed: Dec. 4, 1996

Related U.S. Application Data

[63] Continuation-in-part of Ser. No. 291,017, Aug. 15, 1994, abandoned.

[51] Int. Cl.[6] ..... A63B 23/025

[52] U.S. Cl. ..... 482/10; 482/110

[58] Field of Search ..... 482/10, 110; 601/39; 5/636

[56] References Cited

U.S. PATENT DOCUMENTS

| | | |
|---|---|---|
| 4,166,459 | 9/1979 | Nightingale . |
| 4,210,134 | 7/1980 | Okazaki et al. . |
| 4,468,023 | 8/1984 | Solloway . |
| 4,850,067 | 7/1989 | Latorre . |
| 4,893,808 | 1/1990 | McIntryre et al. . |
| 5,033,138 | 7/1991 | Hong . |
| 5,129,881 | 7/1992 | Pope . |
| 5,176,707 | 1/1993 | Phillips . |
| 5,318,494 | 6/1994 | Santighian . |
| 5,337,429 | 8/1994 | Tucker . |
| 5,338,277 | 8/1994 | Yang . |
| 5,343,582 | 9/1994 | Baylor . |

*Primary Examiner*—Lynne A. Reichard

*Attorney, Agent, or Firm*—Litman, McMahon and Brown, L.L.C.

[57] ABSTRACT

An isometric neck exerciser includes a main platform that houses three separate cushioned supports. A first of the supports is contoured and positioned to maintain firm pressure on the mid cervical spine. The second support is contoured to form a notch which is positioned to maintain firm pressure on the upper cervical vertebra and to contact a plurality of acupressure points. The third support is positioned to provide general positive support for the base of the skull. Each support reliably achieves constant support for the particular portion of the cervical system as the neck is moved through three primary axes of motion, (flexion/extension, lateral flexion and rotation). One or more stepping platforms can be added to selectively elevate the main platform to tailor the exerciser for different sized individuals.

22 Claims, 1 Drawing Sheet

ISOMETRIC NECK EXERCISER AND METHOD

CROSS REFERENCE TO RELATED APPLICATIONS

This application is a continuation-in-part of application Ser. No. 08/291,017, filed Aug. 15, 1994, and entitled ISOMETRIC NECK EXERCISER now abandoned.

FIELD OF THE INVENTION

The present invention relates to an isometric neck exerciser, and, more particularly, to such an isometric exerciser which includes a contoured main platform upon which are placed three supports. A first of the supports is sized, contoured and positioned to maintain firm pressure on the mid cervical spine. The second support is contoured and positioned to maintain firm pressure on the top rear portion of the neck, including the top or "atlas" vertebrae. The third support is positioned to provide general positive support for the back of the user's skull when the user is in a supine position. When a user is properly positioned in a supine position with their head resting on the third support, controlled movement of the head and neck exercises and strengthens the neck muscles and aligns the upper spine.

BACKGROUND OF THE INVENTION

Many medical practitioners, particularly including osteopaths and chiropractors, have long recognized the importance of properly aligned neck vertebrae and strong neck muscles in the overall health of their patients. Literally millions of chiropractic patients make regular visits to their doctors for "neck adjustments" in which the upper vertebrae are aligned by manual manipulation and stimulation. Many patients have experienced a lessening or elimination of headache symptoms, better breathing, increased oxygen flow to the brain, a lessening of sinus problems, and other benefits from these adjustments.

A problem with this practice is that, typically, the benefits of such adjustments are temporary since the same root causes of vertebrae misalignment recur shortly after the patient leaves the practitioner's office. This means that repeated, often expensive visits to the chiropractor or osteopath must be made in order to maintain the health benefits of this treatment.

One of the major causes of upper vertebrae misalignment is simply lack of strength and muscle tone in the region. There have been several attempts to develop a "do it yourself" neck alignment and exerciser which patients can use in their own home to strengthen and tone the muscles in the region of the upper vertebrae while also straightening and aligning the vertebrae. Among these are U.S. Pat. No. 4,893,808 to Donald McIntyre et al. and entitled Exercise Apparatus for the Neck. This apparatus is an elaborate machine in which a person is strapped via a seat belt and shoulder harness. A clamp rests on the person's head and selective resistance is provided by the machine against neck movement in three axes.

Another example is taught in U.S. Pat. No. 5,176,707 to Edward Phillips and entitled Spinal Adjustment Device. This apparatus employs a tubular frame with a belt suspended downward from the center. A person's feet are elevated and the belt placed about the person's waist. The belt is raised via an adjustment flywheel and the user's feet are placed over a bar which places the person's spine at an angle to stretch the spine.

These two patents are somewhat typical of neck exercise equipment which usually employ weights, pulleys, harnesses, etc., often in addition to large frames and motors. This equipment is bulky, complex, expensive, uncomfortable, prone to breakdown, and can be dangerous if pre-loaded with excess weight.

It is well known that isometric exercise entailing use of muscles against resistance will increase muscle strength and reduce swelling and pain. However, due to the complexity of the human cervical anatomy, it has been difficult to focus constant pressure on the neck as it travels through the three primary axes of motion (flexion/extension, lateral flexion and rotation).

It is clear, then that a need exists for a simple, compact, reliable and inexpensive exercise apparatus which safely and effectively exercises and strengthens the neck muscles and aligns the upper cervical vertebrae. Such an apparatus should preferably include no moving parts, but should allow safe and secure support of the head and neck during exercise. The apparatus should focus constant pressure on the neck area as it is moved through the three primary axes of motion, but without requiring weights, restraints or a bulky frame work.

SUMMARY OF THE INVENTION

The inventive isometric neck exerciser includes a main platform that houses three separate cushioned supports. A first of the supports is contoured and positioned to maintain firm pressure on the mid cervical spine. The second support forms an upper cervical notch which is contoured and positioned to maintain firm pressure on the top or upper cervical vertebrae (Atlas), as well as providing pressure against at least five acupressure points alongside the upper vertebrae. The third support is positioned to provide general positive support for the back of the skull. Each support reliably achieves constant support for the particular portion of the cervical system when the user is lying in a supine position with their head placed on the third support and as the neck muscles are tensed in opposition to the supports and as the user's neck is moved through the three primary axes of motion. In addition to the main platform, one or more stepping platforms are provided to selectively elevate the main platform to tailor the use of the exerciser for different individuals.

OBJECTS AND ADVANTAGES OF THE INVENTION

The objects and advantages of the present invention include: providing an improved isometric neck exerciser; providing such an exerciser which includes a contoured main platform upon which are placed a series of supports; providing such an exerciser in which the platform and a first of the supports are positioned and contoured to provide support and to maintain firm pressure on the user's mid cervical spine; providing such an exerciser in which the platform and a second of the supports forms an upper cervical notch which is positioned and contoured to provide support and to maintain firm pressure on the user's upper cervical vertebrae, as well as to provide pressure against at least five acupressure points; providing such an exerciser in which the platform and a third of the cushions is positioned and contoured to provide support and to maintain firm pressure on the back of the user's skull; providing such an exerciser which reliably achieves constant support for each portion of the user's cervical system as the neck muscles are tensed in opposition to the supports and as the neck is moved through the three primary axes of motion; providing such an exerciser in which one or more stepping platforms are provided to selectively elevate the main platform and supports to tailor the use of the exerciser for different individuals; and providing such an exerciser which is relatively simple, economical to manufacture, yet is durable and is particularly well suited to its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
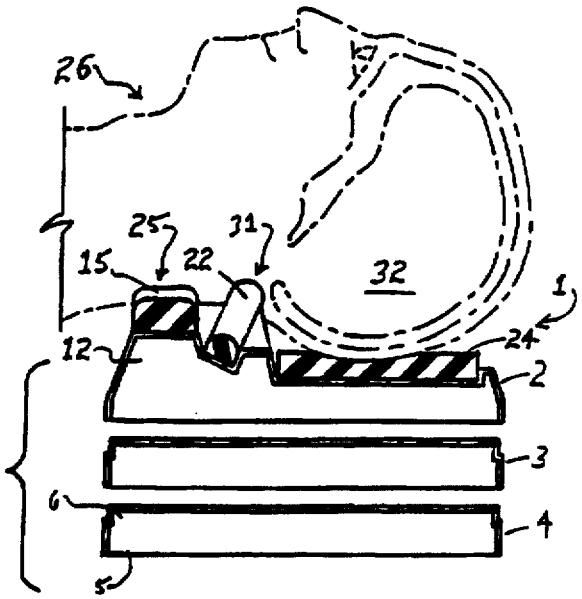
FIG. 1 is a sectional view taken on line 1—1 of FIG. 3.
Figure 2:
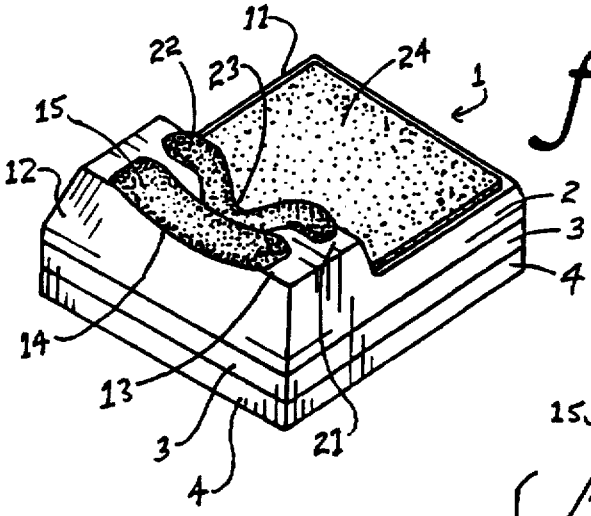
FIG. 2 is an assembled, perspective view of the invention.
Figure 3:
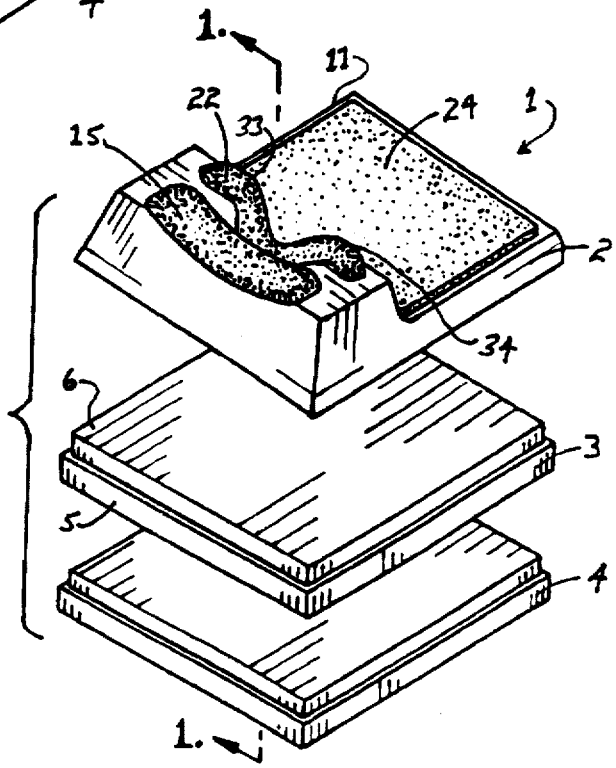
FIG. 3 is an exploded perspective view of the preferred embodiment of the invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawing figures, the isometric neck exerciser, generally indicated at 1, includes a main platform 2 which selectively interlocks with a first of a pair of identical stepping platforms 3 and 4. Each of the stepping platforms 3 and 4 includes a base portion 5 of a first area dimension, and an interlocking upper portion 6 of a second, smaller area dimension. The base portion 5 of each stepping platform is at least partially hollow, as is the main platform 2, such that the interlocking upper portion 6 of stepping platforms 3 and/or 4 can be received therein to selectively elevate the main platform 2. Although not shown, a hook and loop fastener or other fastening system can be provided to removably attach the main platform 2 to either of the stepping platforms 3 or 4, as well as to removably attach the two stepping platforms 3 and 4 together. The main platform 2 and the stepping platforms 3 and 4 can both be injection molded of polyurethane or other plastic materials.

The main platform 2 includes a level step portion 11 and a raised step portion 12. The raised step portion 12 includes a first contoured area 13 which forms a shallow depression 14 to accommodate a first support 15. The raised step portion 12 also includes a second contoured area 21 and a second support 22 which collectively form a deeper depression or "upper cervical" notch 23 with the notch 23 and support 22 being angled downward and forward in the direction of the first contoured area 13, as is best illustrated in FIG. 1. The level step portion 11 accommodates a flat support 24. Each of the supports 15, 23 and 24 can be injection molded of a firm, non-compressible, synthetic rubber. Each of the contoured areas 13, 21 and the level step portion 11, as well as the respective supports 15, 23 and 24 are discussed individually below, since each serves an independent support and exercise role.

The contoured area 13 and the support 15 provide mid cervical support, as well as supplying firm and steady anterior traction to the mid cervical spine 25 of a user 26 lying in a supine position, as is shown in phantom in FIG. 1. Their purpose is four fold, namely (1) to activate the muscle groups of the mid cervical spine 25, both posterior and anterior; (2) to release structural tension from tense or spasmed muscles; (3) to open the intervertebral foramen while minimizing nerve root compression; and (4) to progressively restore a person's normal lordotic curve. In a preferred embodiment, the support 15 in the contoured area 13 is convexly curved from top to bottom with its lowest elevation in the center of the support 15, with the support being approximately ½" wide, slightly raised from front to back, and with the support 15 being approximately ¾" deep.

The contoured area 21 and the support 22 form the upper cervical notch 23 contoured to receive the user's first cervical vertebra (Atlas) 31 and to allow its transverse processes to be used as levers against the non-compressible support 22. In a preferred embodiment, the support 22 in the upper cervical notch 23 is approximately ¾" wide and is convexly curved from top to bottom with a maximum height of 3½", is concavely curved from side to side, is 6½" long, and drops 2" from its maximum height to its minimum height in the center of the support 22. The upper cervical notch 23 and the support 22 are angled downward and forward on an incline of approximately 23 degrees, as shown in FIG. 1, to provide angulation between the occipital condyles and the upper surfaces of the lateral masses of the first cervical vertebra to accommodate proper alignment between the head and neck. The upper cervical notch 23 and support 22 are designed to counteract upper cervical subluxation, which is often considered to be the most detrimental condition to the central nervous system, and thus the global function of the body.

The level step portion 11 and the support 24 extend backward from the upper cervical notch 23 and form a headrest cushion. The support 24 is a firm rectangular pad whose purpose is to support the back of the user's skull 32 and unload its counterweight of between 10 and 13 pounds. Once this structural load is removed, tension on the user's neck is lessened and the user can now use the support 24 as a pivotal point around which the head and neck can focus on the three primary axes of motion (flexion/extension, lateral flexion and rotation).

With the inventive neck exerciser 1 always providing firm and constant resistance, there is no danger of overload as with previous equipment since the user is always in immediate and total control of the pressure applied.

The main platform 2 is suitable for use alone for young persons and adults with small necks. As the user's neck size increases, the first stepping platform 3 may be added, and, with still larger necks, the second stepping platform 4 is added. In a preferred embodiment, each of the stepping platforms 3 and 4 adds ¾" to the height of the main platform 2.

The inventive neck exerciser 1 exhibits a number of advantages over prior art systems. With the exerciser 1, a user can independently select a specific location where pressure is to be applied and can easily control that pressure as he or she alone determines, to tone and create symmetry in the musculature of the neck. The exerciser 1 allows a user to rehabilitate a weak or injured cervical spine and to increase the range of motion in its three primary axes (flexion/extension, lateral flexion and rotation). The exerciser 1 applies corrective counter stressing forces to the spine to restore the optimum lordosis to the cervical spine by restoring the paraspinal soft tissues of muscles and ligaments to normal positions and lengths. As a result, the normal lordotic curve of the neck is restored along with the normal function and health of the spine. The exerciser 1 provides firm constant anterior traction presented by the mid cervical support 15 to open the intervertebral foramen and minimize nerve root compression and reduce swelling and pain. The exerciser 1 can improve the venous and arterial circulation to and from the brain by realignment, when needed, of the foramina transversaria of the first six cervical vertebra as they pass through these bony structures, thereby reducing cerebra ischemia and lessening the pain associated with many types of headaches. The upper cervical notch 23 and support in the exerciser 1 provides a contoured support against which a person can apply controlled pressure in an anterior direction and can use the transverse processes of the first cervical vertebra as levers to stretch and release tension on muscles that may be in spasm. This provides angulation between the upper cervical vertebra (Atlas) and the occipital bone to accommodate the anatomical transition between the head and neck to realign Atlas if necessary with the occipital condyles above thus restoring proper alignment and symmetry. In addition, the upper cervical notch 23 is positioned such that the notch 23 focuses pressure on at least five, and, depending upon the degree of rotation of the neck, up to seven Chinese acupressure points, which, when stimulated, release endorphins and other natural pain killers manufactured by the human body. Finally, the exerciser 1 releases counter load pressure on the cervical region by supporting the weight of the user's head on the headrest support 24 and removing structural tension from the muscles of the upper neck and head, as well as suspending the head on a focal pivot point as the neck is exercised through its three primary axes of motion (flexion/extension, lateral flexion and rotation).

It is to be understood that while certain forms of the present invention have been illustrated and described herein, it is not to be limited to the specific forms or arrangement of parts described and shown.

What is claimed and desired to be secured by Letters Patent is as follows:

1. A neck exercising apparatus, comprising:

a) a main platform which supports and provides resistance for the neck of a user, said main platform including:

i) a first, relatively level step portion sized and positioned to support the head of a user lying in a supine position; and ii) a second, raised step portion which is elevated with respect to said first step portion and which is contoured, sized and positioned to support the user's upper cervical vertebrae and mid cervical spine while the user is in the supine position, said raised step portion including a first contoured area which is slightly concave and which is sized and positioned to cradle and support the user's mid cervical spine and a first support positioned on said first contoured area.

2. An exercise apparatus as in claim 1, wherein said raised step portion also comprises:

a) a second contoured area which includes a notch shape which is sized and positioned to form an upper cervical notch which cradles and supports the user's upper cervical vertebrae.

3. An exercise apparatus as in claim 2, and further comprising a second support positioned in said notch.

4. A neck exercising apparatus as in claim 2, wherein said upper cervical notch is sized and positioned to provide pressure on a plurality of the user's cervical acupressure points.

5. An exercise apparatus as in claim 2, wherein said upper cervical notch is positioned at an angle with respect to vertical.

6. An exercise apparatus as in claim 2, wherein said upper cervical notch is positioned at an angle of approximately 23 degrees with respect to vertical.

7. An exercise apparatus as in claim 1, and further comprising a stepping platform which interlocks with said main platform to selectively elevate said main platform.

8. A neck exercising apparatus which provides a user's neck area with resistance and support through three primary axes of motion, with counter load pressure determined and controlled by the user, said apparatus comprising:

a) a first, relatively level step portion sized and positioned to support the head of the user while lying in a supine position; and b) a second, raised step portion which is elevated with respect to said first step portion and which includes a contoured area with an upper cervical notch which is positioned to support the user's upper cervical vertebrae while the user is in the supine position with their head resting on said level step portion, and including a support positioned in said upper cervical notch.

9. A neck exercising apparatus as in claim 8, wherein said upper cervical notch is sized and positioned to provide pressure on a plurality of the user's cervical acupressure points.

10. A neck exercising apparatus as in claim 8, wherein said raised step portion also includes an additional contoured area which is slightly concave and which is sized and positioned to cradle and support the user's mid cervical spine.

11. An exercise apparatus as in claim 10, and comprising a support positioned on said additional contoured area.

12. An exercise apparatus as in claim 8, wherein said upper cervical notch is positioned at an angle of approximately 23 degrees with respect to vertical.

13. A method of exercising a person's neck, comprising the steps of:

a) lying in a supine position on a surface while positioning the person's skull on a headrest which is elevated to a first level with respect to said surface;

b) placing the person's first cervical vertebrae in an upper cervical notch which is elevated to a second level with respect to said surface, said second level being higher than said first level; and c) moving the user's neck through one or more of three primary axes of motion.

14. A method as in claim 13, wherein, in said placing step, said upper cervical notch is inclined downward and forward at an angle with respect to vertical.

15. A method as in claim 13, and further comprising the step of:

a) using sides of the upper cervical notch to selectively place pressure on a plurality of the person's acupressure points.

16. A method as in claim 13, and further comprising the step of:

a) placing the person's mid cervical spine on a cradle which elevated to a third level with respect to said surface, which third level is higher than said first level, with said cradle being concave and sized and positioned to cradle and support the user's mid cervical spine.

17. A neck exercising apparatus, comprising a main platform which supports and provides resistance for the neck of a user, said main platform including:

a) a first, relatively level step portion sized and positioned to support the head of a user lying in a supine position; and b) a second, raised step portion which is elevated with respect to said first step portion and which is contoured, sized and positioned to support the user's upper cervical vertebrae and mid cervical spine while the user is in the supine position, said second, raised step portion including:

i) a first contoured area which is slightly concave and which is sized and positioned to cradle and support the user's mid cervical spine; and ii) a second contoured area which includes a notch shape which is sized and positioned to form an upper cervical notch which cradles and supports the user's upper cervical vertebrae.

18. An exercise apparatus as in claim 17, and further comprising a support positioned on said first contoured area.

19. An exercise apparatus as in claim 17, and further comprising a support positioned in said notch.

20. A neck exercising apparatus as in claim 17, wherein said upper cervical notch is sized and positioned to provide pressure on a plurality of the user's cervical acupressure points.

21. An exercise apparatus as in claim 17, wherein said upper cervical notch is positioned at an angle with respect to vertical.

22. A neck exercising apparatus, comprising:

a) a main platform which supports and provides resistance for the neck of a user, said main platform including:

i) a first, relatively level step portion sized and positioned to support the head of a user lying in a supine position; and ii) a second, raised step portion which is elevated with respect to said first step portion and which is contoured, sized and positioned to support the user's upper cervical vertebrae and mid cervical spine while the user is in the supine position; and b) a stepping platform which interlocks with said main platform to selectively elevate said main platform.

* * * * *